United States Patent [19]

Mizutani

[11] Patent Number: 4,912,514

[45] Date of Patent: Mar. 27, 1990

[54] ELECTROPHOTOGRAPHIC PRINTER

[75] Inventor: Nagao Mizutani, Tokyo, Japan

[73] Assignee: Citizen Watch Co., Ltd., Tokyo, Japan

[21] Appl. No.: 194,292

[22] Filed: May 14, 1988

[30] Foreign Application Priority Data

May 19, 1987 [JP] Japan ..... 62-122891

[51] Int. Cl.[4] ..... G03G 15/14; G03G 15/20; H05B 5/00; H05B 1/00

[52] U.S. Cl. ..... 355/272; 219/216; 219/10.57; 355/282; 355/285

[58] Field of Search ..... 355/271, 272, 275, 276, 355/277, 279, 281, 282, 285, 289, 290; 219/216, 10.57

[56] References Cited

U.S. PATENT DOCUMENTS 3,893,761 7/1975 Buchan et al. ..... 355/272

4,112,285 9/1978 Pan et al. ..... 355/282 X 4,585,319 4/1986 Okamoto et al. ..... 355/271 X

*Primary Examiner*—A. T. Grimley

*Assistant Examiner*—E. Pipala

*Attorney, Agent, or Firm*—Koda & Androlia

[57] ABSTRACT

A printer used as an electronic copying machine or a non-impact page printer. Toner is attracted to a latent image by using a laser beam or the like, and the toner image is transferred to a recording medium for printing. The toner image is first temporarily fixed on an intermediate transfer medium, and then transferred to the recording medium and permanently fixed thereon. The temporary fixation and the permanent fixation of the toner image are carried out by heating the intermediate transfer medium. The intermediate transfer medium may be heated by an electromagnetic induction heating system.

9 Claims, 5 Drawing Sheets

ELECTROPHOTOGRAPHIC PRINTER

BACKGROUND OF THE INVENTION

1. Field of the Invention

The present invention relates to a printer and, more particularly, to the improvement of the performance of a printer which is usable as an electronic copying machine or a non-impact page printer.

2. Description of the Prior Art

Printing apparatus which are usable as an electronic copying machine or a non-impact pace printer have hitherto adopted various systems such as an electrophotography system, ionography, magetography and electrostatic photography.

In any of these systems, a latent image is first formed electrostatically or magnetically on a photosensitive material. Toner is then attracted to the latent image by electrostatic power, magnetic attractive force or the like, thereby developing the image. The toner image s transferred to a recording medium such as paper and film fix by heat and finally printed.

A first example of conventional printers will now be explained with reference to FIG. 8. A printer of this type is disclosed in Japanese Patent Laid-Open No. 194472/1985.

This kind of printer is a non-impact page printer of an electrophotography system. Input signals such as a signal concerning an image to be printed and a signal input from another data output device are converted to a signal for controlling a laser write unit 12 by a signal processor 10. On the basis of the thus-converted signal, the laser write unit 12 writes a latent image on a photosensitive material, namely, a photosensitive drum 14. Since the photosensitive drum 14 is uniformly charged by an electrifier 16, when the written image is exposed to the laser spot of the laser write unit 12, a predetermined latent image is formed on the surface of the photosensitive drum 14.

The developing unit 18 causes toner to electrostatically adhere to the latent image to form a toner image. A transfer device 22 transfers the toner image to a recording medium, namely, recording paper 20 which is fed in synchronization with the photosensitive drum 14.

The recording paper 20 with the toner image transferred thereto by the transfer device 22 is separated from the surface of the photosensitive drum 14 by a separator 24. After toner image is transferred from the surface of the photosensitive drum 14, the electrostatic charges are eliminated from the surface by a static eliminator 26 and the toner remaining on the surface is removed by a cleaner 28. Thus, the photosensitive drum 14 is ready for next printing.

The toner image transferred to the recording paper 20 is fixed on the surface of the recording paper 20 by a fixing device 30. The fixing device 30 is provided with a heat roller 32, for heating the toner on the recording paper 20 to fix it on the recording paper 20, and a press roller 34 which is provided so as to face the heat roller 32 and press the recording paper 20 against the heat roller 32.

The heat roller 32 is provided with a heater 36 therewithin. The header 36 is so controlled as to have a predetermined surface temperature on the basis of the detected value of a sensor 38 for detecting the surface temperature of the heat roller 32. Felt 40 is provided so as to clean the heat roller 32 and prevent the fusion of the recording paper 20.

A second example of conventional printers such as that shown in FIG. 9 is disclosed in U.S. Pat. No. 4,207,101.

In this apparatus, a photosensitive belt 42 with a toner image formed thereon comes into contact with an intermediate roller 44 while the photosensitive belt 42 travels along the periphery of a support roller **42*a*. A bar magnet 44*a* is provided within the support roller 42*a* so as to face the support roller 42*a*. The intermediate roller 44 has a portion consisting of countless magnetic materials which is divided from a part consisting of a non-magnetic material. Therefore, the part consisting of the magnetic materials is magnetized by the bar magnet 44*a*, thereby transferring the toner image which is formed by the toner containing a magnetic material onto the intermediate roller 44**.

A lamp **44*b* irradiates the entire part of the photosensitive belt 42 so as to enhance the efficiency of transferring the toner image to the intermediate roller 44. The toner image transferred to the intermediate roller 44 is then transferred onto the recording paper 20 by pressing the intermediate roller 44 against the recording paper 20 by means of a press roller 46. The toner image is fixed on the recording paper 20 by a heating fixer 48**.

These conventional printers, however, have the following problems.

In the first example, a high voltage must be applied to the transfer device 22 in order to transfer the toner image formed on the photosensitive drum 14 by electrostatic attraction of the toner to the recording paper 20. When the recording paper 20 is separated from the surface of the photosensitive drum 14, application of a considerably high voltage is also required. When such a high voltage is applied, discharge is sometimes produced depending upon the ambient environmental conditions such as humidity. If such discharge is produced, not only the photosensitive drum 14 is deteriorated but also ozone harmful to human body is produced.

Since toner powders have the same electric charge, repulsive force is applied between the toner powders, thereby diffusing and blurring the image at the time of transfer.

In addition, the toner image transferred onto the recording paper 20 has not been fixed, so that when external force such as vibration an shock is applied, the toner image gets out of shape. It is therefore necessary to keep the recording paper 20 out of touch with the surface having the toner image force facing upward so as to retain the toner image by gravity until the toner image is fixed on the recording paper 20. It is also necessary to protect the toner image from external force such as air flow until it has been stabilized.

Since the electrostatic attractive force is microscopically strong, the ratio at which the toner is transferred from the photosensitive drum 14 is at most 70 to 80% in this system, and the residual toner remains on the photosensitive drum 14. It is therefore necessary to remove the residual toner from the photosensitive drum 14 by the cleaner 28.

As a result, the following problems are brought about such as that the printing density becomes low, that the efficiency of the toner is lowered, that the mechanism for accommodating disposed toner becomes complicated, and that a space is required for collecting and accommodating toner periodically.

The toner image is fixed on the recording paper 20 by heating the recording paper 20 together with the toner to a temperature higher than the melting point of the toner. For this purpose, electric power as large as 10 W to several KW is required. Such power is too large for an apparatus for domestic use.

When the recording paper 20 is heated, there are cases where the quality of the paper is deteriorated, the color is changed, the strength is lowered, and the paper is curled.

Since no external force is to be applied to the recording paper 20 until the toner image is fixed, the course through which the recording paper 20 passes is set at a position in the apparatus which is not affected by external force, in other words, at the inner part. Therefore, jamming is likely to be produced during the travel of the recording paper 20 and such an inner part is inconvenient for recovery operation at the time of production of jamming, while a structure for facilitating the recovery operation is very complicated and expensive.

In the second example of the conventional printers, since magnetic force is utilized for transferring the toner image on the photosensitive belt 42 to surface of the intermediate drum 44, it is difficult to harmonize the transfer of the toner image from the photosensitive belt 42 to the intermediate drum 44 with the transfer of the toner image from the intermediate drum 44 to the recording paper 20. More specifically, if the toner image is completely transferred to the surface of the intermediate drum 44, the toner firmly adheres to the surface of the intermediate drum 44, thereby making it difficult to transfer the toner image to the recording paper 20.

On the other hand, if the adhesion between the toner and the surface of the intermediate drum 44 is weak, the transfer from the photosensitive belt 42 to the intermediate drum 44 becomes insecure, and the toner image disadvantageously gets out of shape on the intermediate drum 44.

This apparatus is also restricted in design because no external force must be applied to the recording paper 20 to which the toner image has been transferred from the surface of the intermediate drum 44 until it has been fixed on the recording paper 20.

SUMMARY OF THE INVENTION

Accordingly, it is an object of the present invention to eliminate the above-described problems in the prior art and to provide a printer which has a simple mechanism, which is small in size, which consumes small power, which produces extremely small amount of ozone, which has high printing quality and operational reliability and good operability, and which is capable of greatly simplifying a perfecting press mechanism and greatly improving the durability and the temperature control of the heating means in an intermediate transfer medium.

To achieve this aim, the present invention provides a printer for attracting toner to a latent image to form a toner image and transferring the toner image to a recording medium, the printer comprising an intermediate transfer medium for temporarily fixing the toner image on the surface thereof and thereafter permanently fixing the toner image on the recording medium, and a heating means for heating by an electromagnetic induction system the portion of the intermediate transfer medium at which the toner image is temporarily fixed and the portion of said intermediate transfer medium at which the toner image is permanently fixed.

The toner image formed on the latent image is temporarily transferred to the intermediate transfer medium by locally heating the intermediate transfer medium by a heating means provided in the intermediate transfer medium, thereby fusing the toner on the latent image. The heating means also permanently fixes on the recording medium the toner image which has been temporarily fixed on the intermediate transfer medium.

In this way, temporary, fixation and permanent fixation are carried out by heating the intermediate transfer medium, thereby enabling effective printing.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
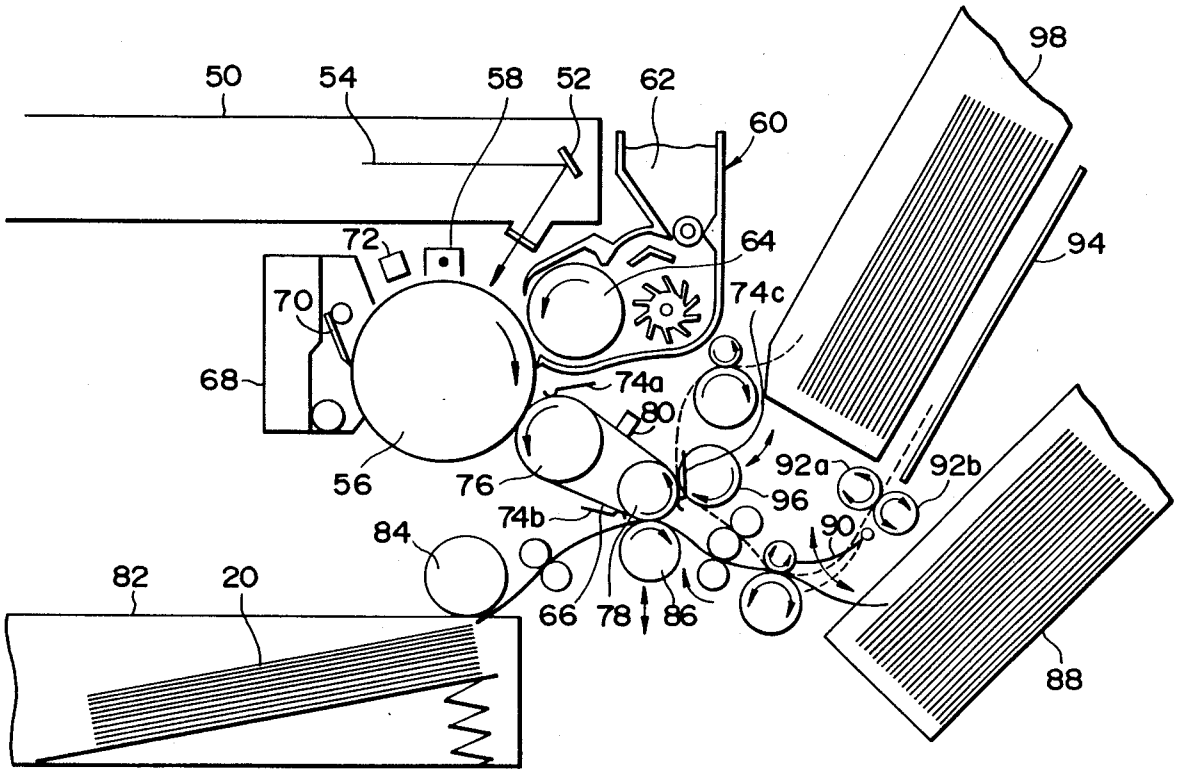
FIG. 1 shows the entire structure of a first embodiment of a printer according to the present invention.

Preferred embodiments of a printer according to the present invention will be explained with reference to the accompanying drawings. FIG. 1 shows the entire structure of a first embodiment of the present invention.

A laser write unit 50 is provided with a mirror 52 therewithin so as to introduce the laser beam 54 produced by a laser light source (not shown) to a predetermined position on the surface of a photosensitive material, namely, a photosensitive drum 56. The photosensitive drum 56 rotates in the direction indicated by the arrow, and the surface thereof is uniformly charged by an electrifier 58. A latent image is electrostatically formed on the surface of the photosensitive drum 56 which is exposed to the laser beam 54 from the laser write unit 50. Toner 62 in a developing unit 60 is attracted to the latent image so as to form a toner image on the surface of the photosensitive drum 56. A roller 64 is provided so as to make the supply of toner uniform.

The toner image formed on the photosensitive drum 56 is transferred to an intermediate transfer medium, which is an intermediate transfer medium coming into contact with the photosensitive drum 56. The surface of the photosensitive drum 56 which has transferred the toner image to the intermediate transfer medium is cleaned by a cleaner 68. The cleaner 68 is provided with a built-in blade 70 for scraping off the toner remaining on the surface of the photosensitive drum 56. A static eliminator 72 eliminate the charges on the surface of the photosensitive drum 56.

The toner image formed on the surface of the photosensitive drum 56 is transferred to the intermediate transfer medium and temporarily fixed on the surface thereof by heating the portion of the intermediate transfer medium which comes into contact with the photosensitive drum 56 by a first heating means. More specifically, the first heating means is so designed that electric power is supplied from a first feeder 74*a* to the portion at which the intermediate transfer medium comes into contact with the photosensitive drum 56 and the intermediate transfer medium itself is locally heated.

The surface of the photosensitive drum 56 and the intermediate transfer medium run at the same rate and come into contact with each other. When the intermediate transfer medium in contact with the photosensitive drum 56 is heated, the toner on the surface of the photosensitive drum 56 fuses due to the heat, thereby being transferred to and temporarily fixed on the surface of the intermediate transfer medium.

At this time, by optimizing the temperature and the contacting time of the intermediate transfer medium, it is possible to prevent the deterioration of the photosensitive drum 56 and further to make the fusing condition of the toner optimum, thereby most of toner is transferred. The amount of toner remaining on the photosensitive drum 56 therefore becomes very small. Accordingly, since the amount of disposed toner collected by the cleaner 68 becomes very small, it is possible to simplify the disposed toner accommodating mechanism, to reduce a space for accommodating the collected toner and to reduce the frequency of collection of the toner.

The intermediate transfer medium, which is an endless belt passed around rollers 76 and 78, travels toward the position at which it comes into contact with the photosensitive drum 56 after the toner and the like are removed by a pad 80 which serves as both a cleaner and a lubricant applicator.

A feeder cassette 82 accommodates the recording medium, namely, the recording paper 20, and a feeder roller 84 supplies the recording paper 20 sheet by sheet to the position at which the recording paper 20 comes into contact with the intermediate transfer medium. A roller 86 is disposed at the opposite position of the roller 78 with the intermediate transfer medium 66 therebetween so as to press the recording paper 20 against the intermediate transfer medium 66. The roller 86 is movable in the direction indicated by the arrow in FIG. 1 and moves apart from the roller 78 at the time of perfecting, as will be described later.

A second heating means is provided on the intermediate transfer medium 66 at the position which comes into contact with the recording paper 20. For this reason, the toner image formed on the surface of the intermediate transfer medium 66 is heated and transferred onto the surface of the recording paper 20 in the semi-fused state. The transferred toner image is thereafter cooled to be permanently fixed on the surface of the recording paper 20. The thus-printed recording paper 20 is introduced to a first delivery cassette 88.

The recording paper 20 is conveyed between the rollers 78 and 86 at a predetermined timing by controlling the feeder roller 84 and a group of other feeder rollers.

A switching shoot 90 is provided above the first delivery cassette 90. The switching shoot 90 can be positioned either at the upper position indicated by the solid line, or the lower portion indicated by the broken line.

When the switching shoot 90 is at the upper position, the recording paper 20 is introduced to the first delivery cassette 88, as described above, while when the switching shot is at the lower position, the recording paper 20 passes through rollers 92*a* and 92*b* so as to be introduced to a relay tray 4. The relay tray 94 is used at the time of perfecting. The relay tray 94 temporarily stores the recording paper 20 with the top side printed on and supplies it again for perfecting.

Since the rollers 92*a* and 92*b* rotate in the opposite directions, the recording paper 20 in the relay tray 94 travels through the route indicated by the broken line toward the portion at which roller 96 and the intermediate transfer medium 66 comes into contact with each other. In order to print on the back side of the recording paper 20, the supply of power to the feeder 74*b* is stopped and power is supplied to a feeder 74*c*. The roller 86 is moved downward apart from the roller 78, as described above, and the roller 96 is pressed against the roller 78. The intermediate transfer medium 66 is therefore heated at the portion which comes into contact with the roller 96.

As a result, the toner image is transferred to the recording paper 20 at this position. The recording paper 20 is then supplied between the rollers 96 and 78 at a predetermined timing by predetermined control of reverse rotations of the rollers 92*a* and 92*b* and the rotations of other rollers. The recording paper 20 with both sides printed on is discharged into a second delivery cassette 98.

In the case of perfecting, since the vertical direction of printing is inverted with respect to the direction of printing on the top side, the image is ordinarily turned upside down in the laser write unit 50.

Figure 2:
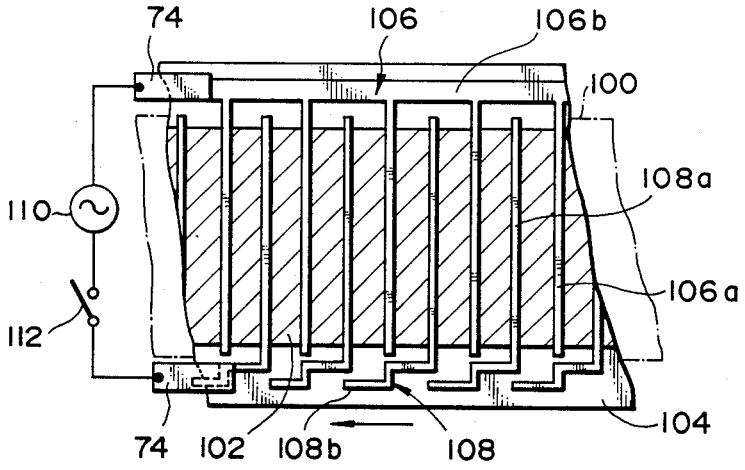
FIG. 2 is a partially sectional plan view of the structure of an intermediate transfer medium of the printer shown in FIG. 1.
Figure 3:
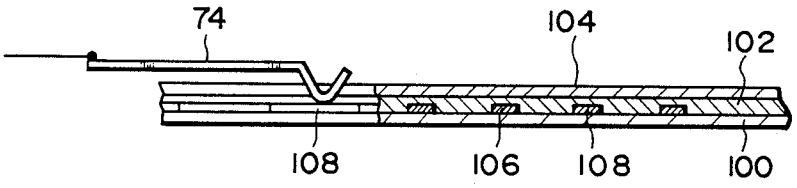
FIG. 3 is a partially sectional front elevational view of the intermediate transfer medium shown in FIG. 2.

The structure of the intermediate transfer medium 66 will now be explained with reference to FIGS. 2 and 3. The intermediate transfer medium 66 has a three-layer structure, composed of a base insulation sheet 100, heating resistor 102 and a surface covering sheet 104. In the interior of the heating resistor 102, extensions 106*a* of collector electrodes 106 and extensions 108*a* of feeder electrodes 108 are alternately arranged. The extensions 106*a* of the collector electrodes 106 are connected to one base 106*b*, while the extensions 108*a* of the feeder electrodes 108 are connected to the respective contact portions 108*b*. The contact portions 108*b* are formed in the shape of a crank in such a manner as to extend toward the direction of the travel of the intermediate transfer medium 66. When electric power is supplied from the feeders 74, it is subsequently supplied to the adjacent feeder electrodes 108. The adjacent contact portions 108*b* are arranged in a complicated configuration with respect to each other so that electric power is supplied simultaneously to the adjacent feeder electrodes 108 at the initial stage and the final stage of a feeding pitch (a period for feeding one feeder electrode). The feeders 74 are so disposed as to come into contact with the base 106*b* of these collector electrodes 106 and the contact portions 108*b* of the feeder electrodes 108, respectively.

The pair of electrodes 74 disposed on both sides of the intermediate transfer medium 66 are connected to a power source 110 and the supply of power is controlled by a switch 122. When the switch 112 is closed and a voltage is applied between the collector electrodes 106 and the feeder electrodes 108, a current flows from the extension 108*a* of one feeder electrode 108 toward the extensions 106*a* of the two collector electrodes 106 on both sides of the feeder electrode 108. The current heats the heating resistor 102 and the energized portion is heated to a predetermined high temperature. The above described structure of the feeders 74 and the contact portions 108*b* enables incessant heating between the pitches of the feeder electrodes 108 and keeps the local heating consecutive and smooth, thereby providing the intermediate transfer medium 66 with a locally high temperature with a gentle temperature gradient.

When the top side of the recording paper 20 is printed on, electric power is supplied to both first feeder 74*a* and second feeder 74*b* to carry out temporary fixation and permanent fixation, respectively. When the back side of the recording paper 20 is printed on, electric power is supplied to the first feeder 74*a* and the second feeder 4*c*.

The contact portions 108*b* of the feeder electrodes 108 are extended in the longitudinal direction of the intermediate transfer medium 66. Therefore, the position at which the feeders 74 come into contact with the intermediate transfer medium 66 slightly deviates from the position at which the intermediate transfer medium 66 is heated. Accordingly, since the position at which the feeders 74 are set deviates from the position at which the rollers are set, the feeders can be set without being interfered by a roller supporting mechanism or the like, and the wiring and the maintenance thereof are facilitated.

The base insulation sheet 100 prevents a current from flowing to the rollers and the like, thereby providing the intermediate transfer medium 66 with sufficient strength. The base insulation sheet 100 is generally made of a synthetic resin such as polyimide. For the surface covering sheet 104, a material excellent in heat insurance, chemical resistance, releasability, toner receiving property, toner transferring property, etc, for example, silicone rubber is used.

For the eating resistor 102, a material having a rapid positive resistance temperature characteristic such as a mixture of an ethylene vinyl acetate copolymer and graphite is used. If such a material is used, since the resistance is increased in proportion to the temperature, it is possible to provide a self control characteristic with respect to temperature. Feedback control utilizing a temperature sensor is therefore dispensed with. It is possible to set the temperature distribution of the intermediate transfer medium 66 as desired by varying the pattern of the extensions 106*a* and 108*a* of the feeder electrodes 106 and the collector electrodes 108, respectively. Although the first heating means and the second heating means are provided separately from each other in this embodiment, it is possible to design them as one heating means.

The intermediate transfer medium 66 is not restricted to the one shown in this embodiment, and a drum-like heater and a heater having predetermined curved surface or flat surface may be used. In this case, a non-plastic material is usable as the heater.

It is preferable to provide a sensor for measuring the position of the recording paper 20 and control the group of feeder rollers on the basis of the signal from the sensor in order to print a predetermined image at a predetermined position of the recording paper 20.

In this embodiment, the printer of an electrophotography system is explained, but the present invention is effectively applicable to other systems.

For example, an electrostatic drum for ionography, a magnetic recording drum for magnetography, etc. may be used as a photosensitive material.

As described above, the printer of this embodiment brings about the following advantages:

(a) Since the toner image is transferred to the intermediate transfer medium, namely, the intermediate transfer medium 66 by heating, the toner transfer ratio is enhanced, which fact leads to easy cleaning of the photosensitive drum 56 and reduction in the amount of disposed toner. In addition, it is possible to keep a high printing density.

(b) Since heat is utilized for transferring the toner image from the photosensitive drum 56, extremely small amount of ozone is produced and no high voltage is required.

(c) Since the toner image is transferred by heating there is no electrical repulsion between the toner powders, thereby eliminating the danger of diffusing and blurring the image.

(d) When the toner image is transferred to the recording paper 20, not the recording paper 20, which is successively fed from the outside, but the intermediate transfer medium 66 is heated to a high temperature. Since it is not necessary to heat the intermediate transfer medium 66 to a very high temperature (a temperature slightly above the melting point of the toner is sufficient) and local heating suffices, the heating energy required is small and the recording paper 20 is not deteriorated.

(e) The toner image is transferred from the photosensitive drum 56 to the intermediate transfer medium 66 and temporarily fixed on the intermediate transfer medium 66 by heat. The temporarily fixed toner image is further transferred from the intermediate transfer medium 66 to the recording paper 20 and permanently fixed on the recording paper 20. Consequently, even if external force is applied to the intermediate transfer medium 66 and the recording paper 20 to which the toner image is transferred, there is no danger of the image getting out of shape. It is therefore possible to set the route of travel of the recording paper 20 as desired, thereby making the apparatus compact as a whole.

(f) Since it is possible to set the route of travel of the recording paper 20 as desired, printing on the side of the recording paper 20 which faces downward is also enabled at the time of perfecting, thereby enabling substantial miniaturization of the apparatus.

(g) For the above reasons, the power consumed is reduced to about 1/10 of that of a conventional printer. Thus, since the economical efficiency of the printer of the present invention is high, it is also applicable to personal use. In addition, the economical efficiency in designing and manufacturing the printer is also increased to a great extent.

As described above, according to the present invention, since the printer is provided with an intermediate transfer medium, and the toner image is temporarily and permanently fixed by heating the intermediate transfer medium, various advantages are brought about such as efficient printing, improvement of printing quality, reduction in power consumed, miniaturization of the apparatus and great simplification of the mechanism for perfecting.

Figure 4:
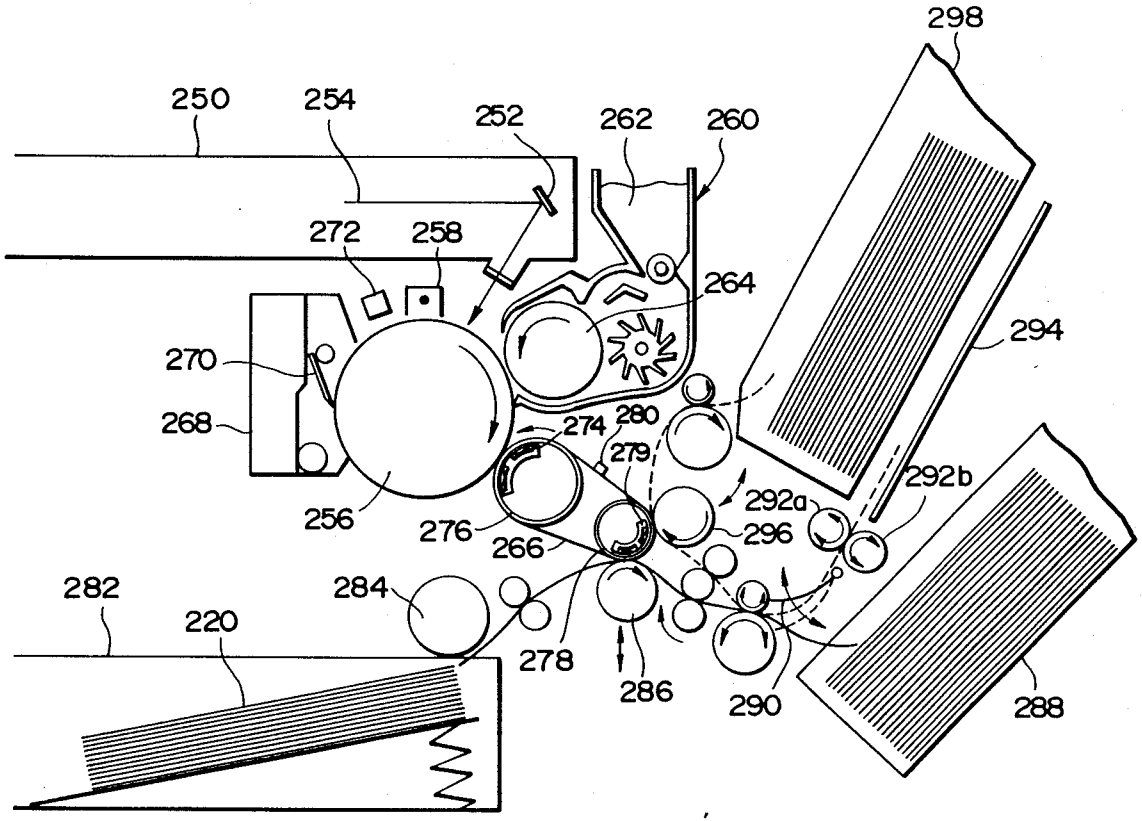
FIG. 4 shows the entire structure of a second embodiment of a printer according to the present invention.

A second embodiment of the present invention will be explained hereinunder with reference to FIG. 4 which shows the entire structure thereof. In this embodiment, the elements corresponding to those in the first embodiment are represented by the same numerals prefixed by the numeral 2. In the second embodiment, at the portion of an intermediate transfer medium 266 which comes into contact with a photosensitive drum 256, a first heating means is formed in such a manner that the portion is locally heated by the Joule heat of an eddy current which is induced to the conductive portion **266*b* of the intermediate transfer medium 266 by the action of the high-frequency current applied to a heating coil 274. At the portion of the intermediate transfer medium 266 which comes into contact with the recording paper 20, a second heating means heated by receiving the electromagnetic induction from a second heating coil 279**.

The toner image on the surface of the photosensitive drum 256 is temporarily fixed on the surface of the intermediate transfer medium 266 by heating the intermediate transfer medium 266 by the first heating means in the same way as in the first embodiment.

The toner image is then transferred to the recording paper by heating the intermediate transfer medium 266 by the second heating means. It is also possible to print on the back side of the recording paper by heating the intermediate transfer medium 266 by the second heating means.

Figure 5:
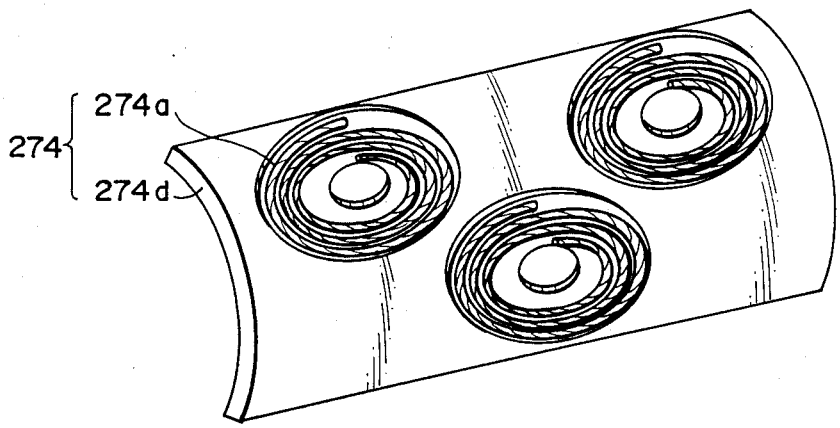
FIG. 5 schematically shows the structure of the heating coil portion of the printer shown in FIG. 4.
Figure 6:
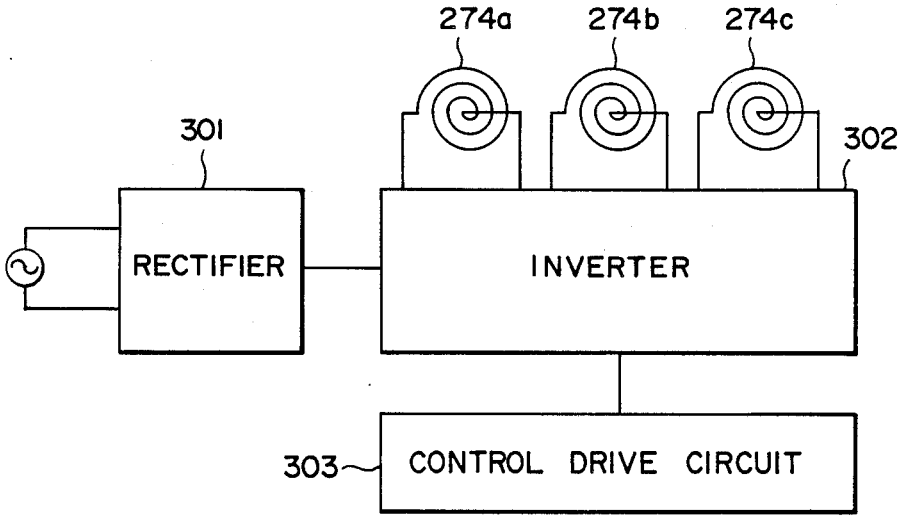
FIG. 6 is a block diagram of the system for feeding to the heating coils of the printer shown in FIG. 4.

The heating coil, 274 will now be explained with reference to FIGS. 5 and 6.

The heating coil 274 is composed of a ferrite magnetic core **274*d* and three coils 274*a*, 274*b* and 274*c* of spiral litz wires each of which is made of stranded and bundled fine copper wires. Recesses in the shape of doughnuts are formed on the magnetic core 274*d* and the coils 274*a*, 274*b* and 274*c*** are inserted into the respective recesses.

An alternating current from a commercial power source is converted into direct current by a rectifier 301, the direct current is controlled by a control drive circuit 303, and the high-frequency current obtained as the output of the invertor 302 is applied to the coils **274*a*, 274*b* and 274*c***.

The heating coil 274 is secured to the inner surface of a roller 276 with a slight space therebetween so as to effect efficient induction heating. It is necessary to select the optimum thickness of the roller 276 and optimum position of the roller 276 relative to the photosensitive drum 256.

The heating coil 279 has the same structure including the current circuitry as the heating coil 274 except for the external shape. In order to enhance the heating efficiency, the position of the heating coil 279 relative to rollers 286 and 296 may be automatically changed in agreement with the movements of the respective rollers depending upon whether printing on the top side or the back side is carried out.

Figure 7:
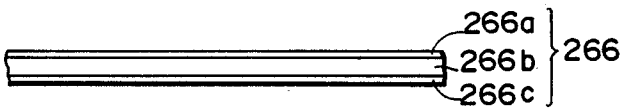
FIG. 7 is a sectional view of the structure of an intermediate transfer belt of the printer shown in FIG. 4.
Figure 8:
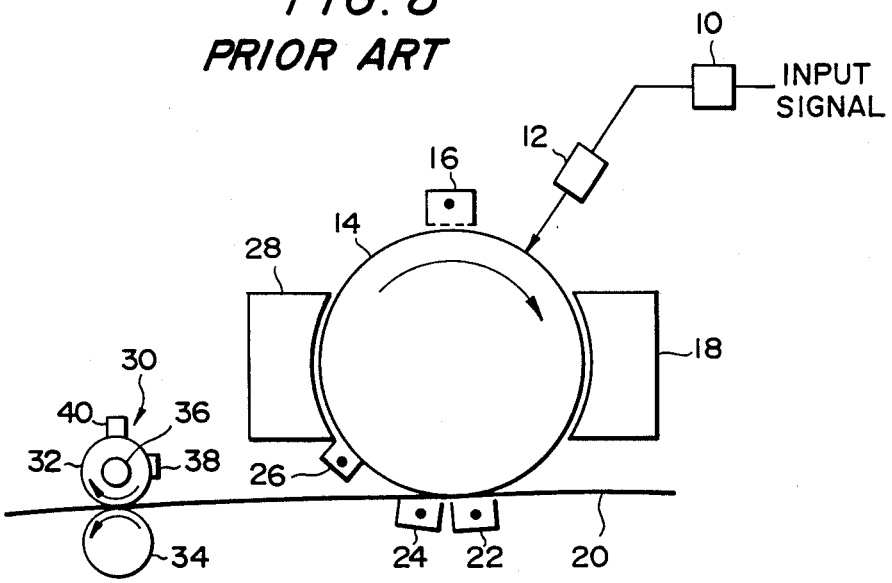
FIG. 8 PRIOR ART
FIG. 8 shows the entire structure of a first example of a conventional printer.
Figure 9:
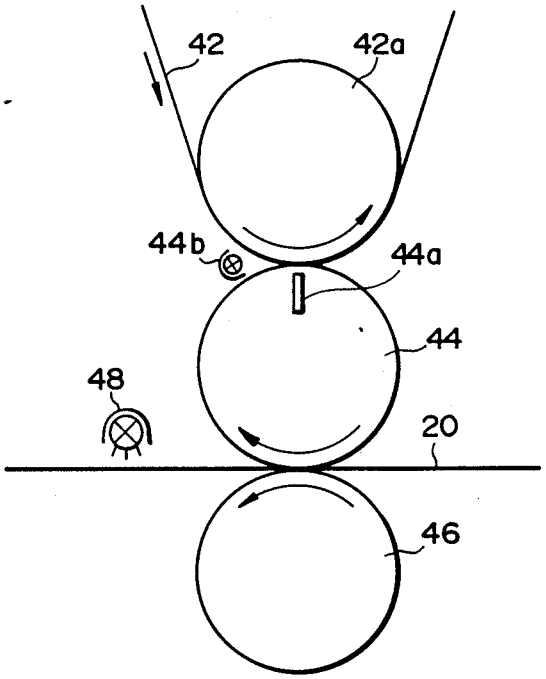
FIG. 9 PRIOR ART
FIG. 9 shows the entire structure of a second example of a conventional printer.

The structure of the intermediate transfer medium 266 will be explained in the following with reference to FIG. 7. The intermediate transfer medium 266 has a three-layer structure, composed of a surface covering sheet **266*a*, a base insulation sheet 266*c* and a heating resistor 266*b***.

The base insulation sheet **266*c* is preferably made of a synthetic resin film such as polyimide in consideration of the heat resistance. The surface covering sheet 266*a*** is preferably made of film of a fluorine resin or the like which is excellent in heat insurance, chemical resistance, releasability, toner receiving property, toner transferring property, etc.

The principle of heating is the same as the principle of heating due to electromagnetic induction which is put to practical use for an electromagnetic cooking range and the like. That is, a high-frequency current applied to the heating coils 274 and 279 induces an eddy current on the heating resistor **266*b*, and the Joule heat locally heats the intermediate transfer medium 266 and raises the temperature of that portion. Since the heating is direct, there is almost no delay, so that even when the intermediate transfer medium 66 is moved, the heating action is effected only in the vicinity of the heating coil 274**.

The temperature distribution of the intermediate transfer medium 266 can be designed as desired by varying the arrangement and the configuration of the coils **274*a*, 274*b* and 274*c*, and devising the distribution of the specific resistance values of the heating resistor 266*b***.

The intermediate transfer medium 266 is not restricted to the one shown in this embodiment, and a drum-like heater and a heater having predetermined curved surface or flat surface may be used.

According to the printer of the second embodiment, in addition to the advantages obtained by the printer of the first embodiment, the following advantages are brought about: that since the induction heating is capable of feeding a heater in a noncontacting state and supplying heating energy, wear members such as collectors are dispensed with, thereby improving the reliability to a great extent and simplifying the mechanism in the vicinity of the paper processing portion. While there has been described what are at present considered to be preferred embodiments of the invention, it will be understood that various modifications may be made thereto, and it is intended that the appended claims cover all such modifications as fall within the true spirit and scope of the invention.

What is claimed is:

1. A printer for attracting toner to a latent image to form a toner image and transferring said toner image to a recording medium, said printer comprising:

an intermediate transfer medium for temporarily fixing said toner image on the surface thereof and thereafter permanently fixing said toner image on said recording medium, said intermediate transfer medium comprising an endless belt; and a heating means for heating the portion of said intermediate transfer medium at which said toner image is temporarily fixed and the portion of said intermediate transfer medium at which said toner image is permanently fixed, said heating means comprising a sheet-form heating resistor provided on said intermediate transfer medium and a source of electrical power locally applied to a portion of said sheet-form heating resistor.

2. A printer according to claim 1, wherein said heating means includes a first heating means for heating said portion of said intermediate transfer medium at which said toner image is temporarily fixed and a second heating means for heating the portion at which said toner image is permanently fixed.

3. A printer according to claim 2, wherein at least two second heating means for carrying out permanent fixations of said toner image are provided so as to carry out said permanent fixation in at least two positions.

4. A printer according to any of claims 1 to 3, wherein said heating means includes a heater provided within said intermediate transfer medium.

5. A printer according to claim 4, wherein said heater is composed of an electric heater and said intermediate transfer medium is locally heated by energizing said electric heater.

6. A printer according to claim 5, wherein said heating means further comprises:

plural collector electrodes which consist of plural collector electrode extensions and a base;

plural feeder electrodes which comprise plural feeder electrode extensions; and said heating resistor incorporates alternately said plural collector electrodes assembled with said base and said plural feeder electrode extensions of which one feeder electrode extension is connected to a contact point to obtain said electric power supply;

whereby current flows to the two collector electrode extensions which are arranged next to the feeder electrode extension and connected to a contact point in said heating resistor.

7. A printer according to claim 1, wherein said intermediate transfer belt has a three-layer structure comprising a base insulation sheet at the bottom, said heating resistor in the middle and a surface covering sheet on its top.

8. A printer for attracting toner to a latent image to form a toner image and transferring said toner image to a recording medium, said printer comprising:

an intermediate transfer medium for temporarily fixing said toner image on the surface thereof and thereafter permanently fixing said toner image on said recording medium; and a heating means for heating the portion of said intermediate transfer medium at which said toner image is temporarily fixed and the portion of said intermediate transfer medium at which said toner image is permanently fixed, said heating means comprising said intermediate transfer medium with a built-in conductive material and a coil, for producing a magnetic line, thereby heating said intermediate transfer medium by an electromagnetic induction heating system.

9. A printer according to claim 8, wherein said heating means is a self temperature control type heating means having as said conductive material a conductive material in which a resistance value has a large positive temperature coefficient.

* * * * *